US007439871B2

(12) United States Patent
Hsieh

(10) Patent No.: US 7,439,871 B2
(45) Date of Patent: Oct. 21, 2008

(54) HAND TOOL WITH AT LEAST TWO ALARM DEVICES

(76) Inventor: Chih-Ching Hsieh, No. 367, Pei Yang Road, Feng Yuan, Taichung Hsien (TW)

( * ) Notice: Subject to any disclaimer, the term of this patent is extended or adjusted under 35 U.S.C. 154(b) by 125 days.

(21) Appl. No.: 11/443,419

(22) Filed: May 31, 2006

(65) Prior Publication Data

US 2007/0279236 A1 Dec. 6, 2007

(51) Int. Cl.
*G08B 21/00* (2006.01)

(52) U.S. Cl. ..... 340/665; 73/760; 73/862.381; 73/21

(58) Field of Classification Search ..... 340/665
See application file for complete search history.

(56) References Cited

U.S. PATENT DOCUMENTS 4,883,022 A * 11/1989 Barker ..... 119/73
6,844,819 B2 * 1/2005 Luebke et al. ..... 340/660
6,920,811 B2 * 7/2005 Hsien ..... 81/467
6,931,969 B2 * 8/2005 Hsien ..... 81/467
2006/0272456 A1 * 12/2006 Hsien ..... 81/119
2007/0273917 A1 * 11/2007 Encrenaz et al. ..... 358/1.15

* cited by examiner

*Primary Examiner*—Jeff Hofsass
*Assistant Examiner*—Ojiako Nwugo
(74) *Attorney, Agent, or Firm*—Ming Chow; Sinorica, LLC

(57) ABSTRACT

A hand tool with at least two alarm devices comprises a flat handle with having a rectangular shape which is formed by has two first parallel surfaces and two second parallel narrow surfaces connected between the two first surfaces; at least one end of the handle being formed with a driving head; an output device having a sensing unit; the sensing unit being electrically connected to a strain gauge installed at a predetermined position of the handle; and the output device having an alarm unit; the alarm unit of the output device being installed at the connection of the handle and the driving head. An auxiliary alarm unit is installed at one surface of the handle, or the auxiliary alarm unit is installed at an inclined recess between two adjacent surfaces of the handle or the auxiliary alarm unit is arranged across two adjacent surfaces of the handle.

12 Claims, 4 Drawing Sheets

HAND TOOL WITH AT LEAST TWO ALARM DEVICES

FIELD OF THE INVENTION

The present invention relates to spanners, and in particular to a hand tool with at least two alarm devices which has an alarm unit and at least one auxiliary alarm unit so that the user can view the alert easily and conveniently.

BACKGROUND OF THE INVENTION

In the prior art, the spanner with at least one strain gauge has the strain gauge being installed at a weak portion of the spanner, referring to FIG. 4. Thus, the strain gauge will measure the deformation of the spanner. The deformation will make a bridge circuit unbalance so as to change a resistance of the strain gauge. Thereby the deformation will change into electric signals to be displayed on a display. An alarm unit is installed in the spanner for alerting the users to know whether an overlarge force is applied to the spanner and thus the user can be alerted and thus the user can screw an object to a predetermined position.

However in the prior art only one alarm unit is installed at a wide surface of the handle. The display and the alarm unit are installed in an output device. However the output device is at a position which is generally held by users. Thus the hand of the user will shield the alarm unit, or if the spanner is operated in a space which is not easily viewed by the user, the user cannot view the alarm and thus the alarm lose its effect. Thereby the output device is held by user and thus the buttons on the output device will be operated by mistake. Further the user's hand will feel ache.

Thus above mentioned prior arts have many defects which are necessary to be improved.

SUMMARY OF THE INVENTION

Accordingly, the primary object of the present invention is to provide a hand tool with at least two alarm devices which has an alarm unit and an auxiliary alarm unit so that the user can view the alert easily and conveniently.

To achieve above objects, the present invention provides a hand tool with at least two alarm devices which comprises a flat handle with having a rectangular shape which is formed by has two first parallel surfaces and two second parallel narrow surfaces connected between the two first surfaces; at least one end of the handle being formed with a driving head; an output device having a sensing unit; the sensing unit being electrically connected to a strain gauge installed at a predetermined position of the handle; and the output device having an alarm unit; the alarm unit of the output device being installed at the connection of the handle and the driving head. An auxiliary alarm unit is installed at one surface of the handle, or the auxiliary alarm unit is installed at an inclined recess between two adjacent surfaces of the handle or the auxiliary alarm unit is arranged across two adjacent surfaces of the handle.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
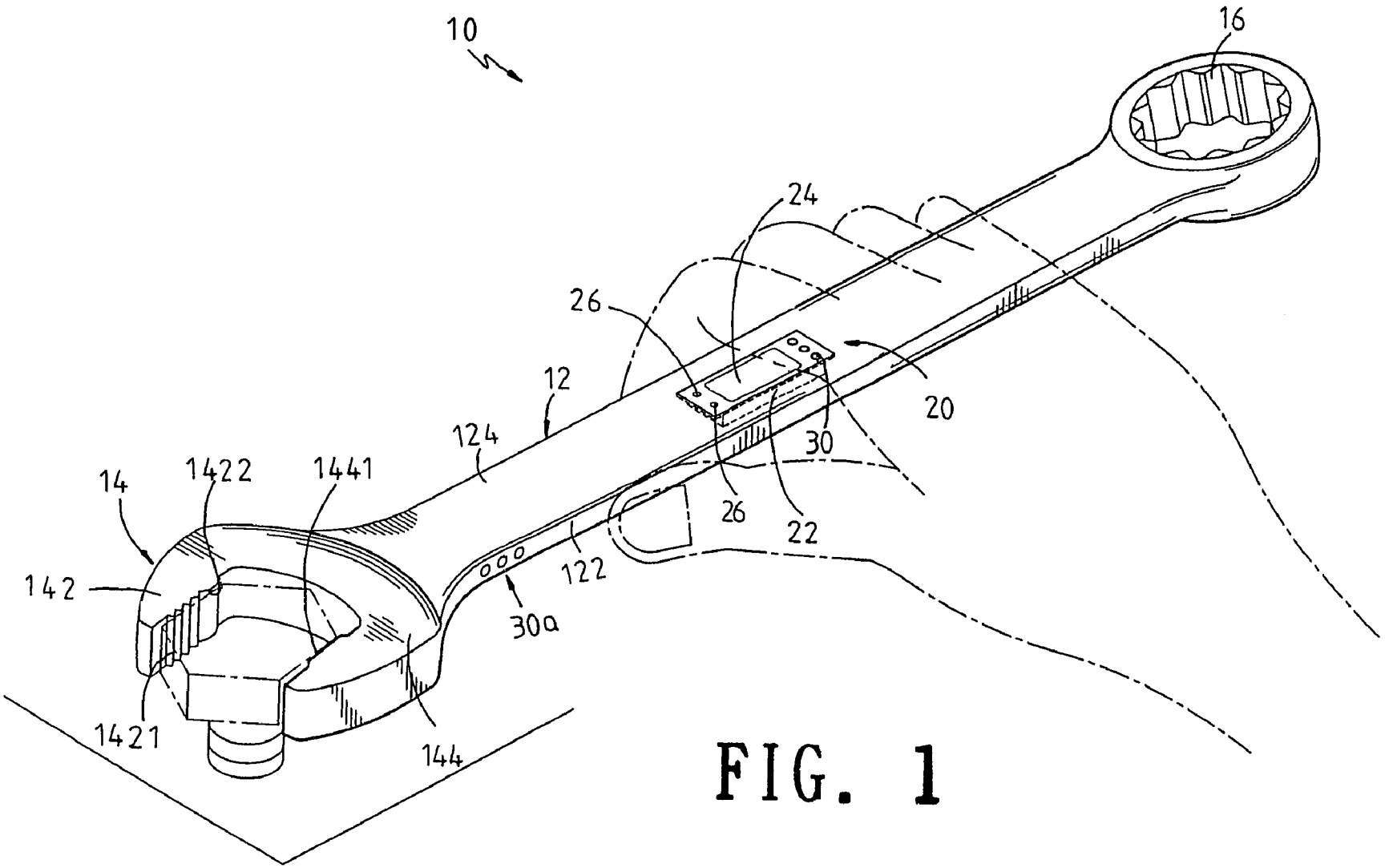
FIG. 1 shows the first embodiment of the hand tool alert device of the present invention.

Referring to FIG. 1, the present invention is illustrated. The present invention has the following elements.

A flat handle 12 with a preset length and a preset width. The handle 12 has a rectangular shape which is formed by has two parallel wider surfaces 124 and two parallel narrow surfaces 122 connected between the two wider surfaces 124. One end of the handle 12 is formed with an opened driving head 14 and another end thereof is a ring driving head 16. The opened driving head 14 has two jaw 142 and jaw 144. One inner surface of one jaw 142 has a teeth portion 1421 having four continuous teeth for enhancing the strength for clamping a screw object and a protruded cambered portion 1422 at an inner side near the handle 12 for reducing the stress at apexes of an object to be driven. It is used to avoid that a greater force will destroy the apexes of the screwing object. An inner surface of another jaw 144 is formed with a protrusion 1441 with a flat surface facing toward another jaw 142. The protrusion 1441 with the flat surface has the effect of protecting the apexes of the object to be driven since no force will apply to the apexes.

An output device 20 has a sensing unit 22 embedded in a recess of the handle 12. The sensing unit 22 is electrically connected to a strain gauge installed at a predetermined position of the handle 12. Preferably, the strain gauge is installed at the connection of the driving head and the handle 12. A surface of the output device 20 has a display 24 for displaying the deformation of the hand tool which is got from the resistance measured from the sensing unit 22. The display 24 are installed with functional setting buttons 26 for turning on and off of the output device 20 and setting the balance of the resistance of the bridge circuit of the strain gauge (i.e. to set the twisting force of the button) or resetting. The output device 20 has an alarm unit 30. It can be formed by a red light, a green light and a blue light. However other forms are permissible. The alarm unit 30 serves to provide alert indication to indicate that the twisting force applied to the screwing object is over a predetermined value.

In the present invention, the alarm unit 30 of the output device 20 is installed at the connection 124 of the handle 12 and the driving head 14. One surface 122 of the handle 12 is installed with an auxiliary alarm unit 30*a*. Thus, when one alarm unit 30 or alarm unit 30*a* is shielded by a hand, another alarm unit 30 or auxiliary alarm unit 30*a* can be seen of the operator.

Figure 2:
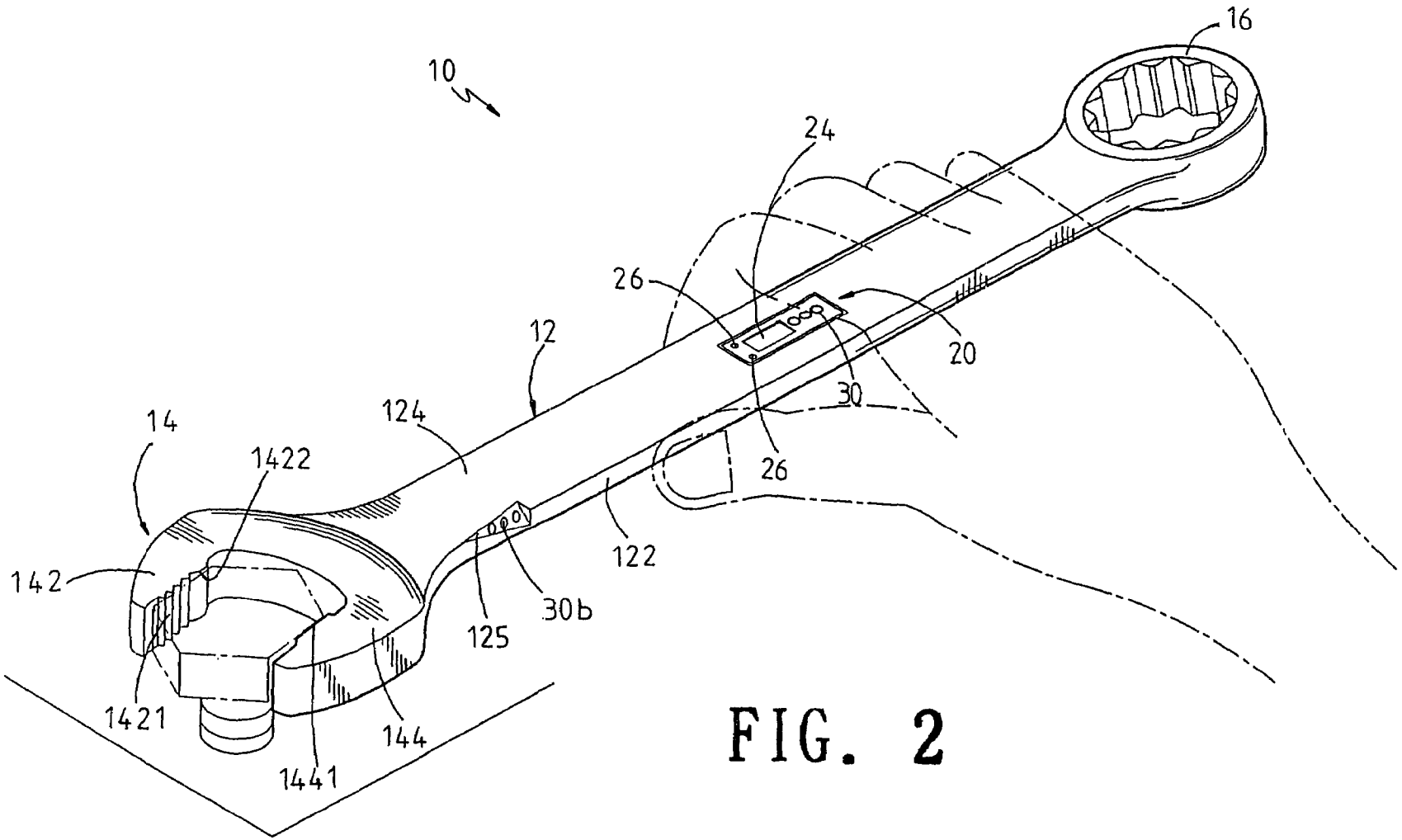
FIG. 2 shows the second embodiment of the hand tool alert device of the present invention.

Referring to FIG. 2, the second embodiment of embodiment is illustrated. Those identical to the first embodiment will not be described. Only those differences are described. A recess 125 is formed by only two inclined triangular surfaces and is formed at an edge between two adjacent surfaces of the handle and at an area near the driving head. An auxiliary alarm device is installed on one of the inclined surfaces. Since the auxiliary alarm unit 30*b* is at a recess portion, it is not protruded from the surface of the handle 12 and thus the hand will feel easy and comfortably. Thereby the auxiliary alarm unit 30*a* can be seen easily.

Furthermore, in the present invention, two recessed inclined surfaces 125 can be installed at two ends of the handle 12, one near the opened driving head 14 and another near the ring driving head 16.

Figure 3:
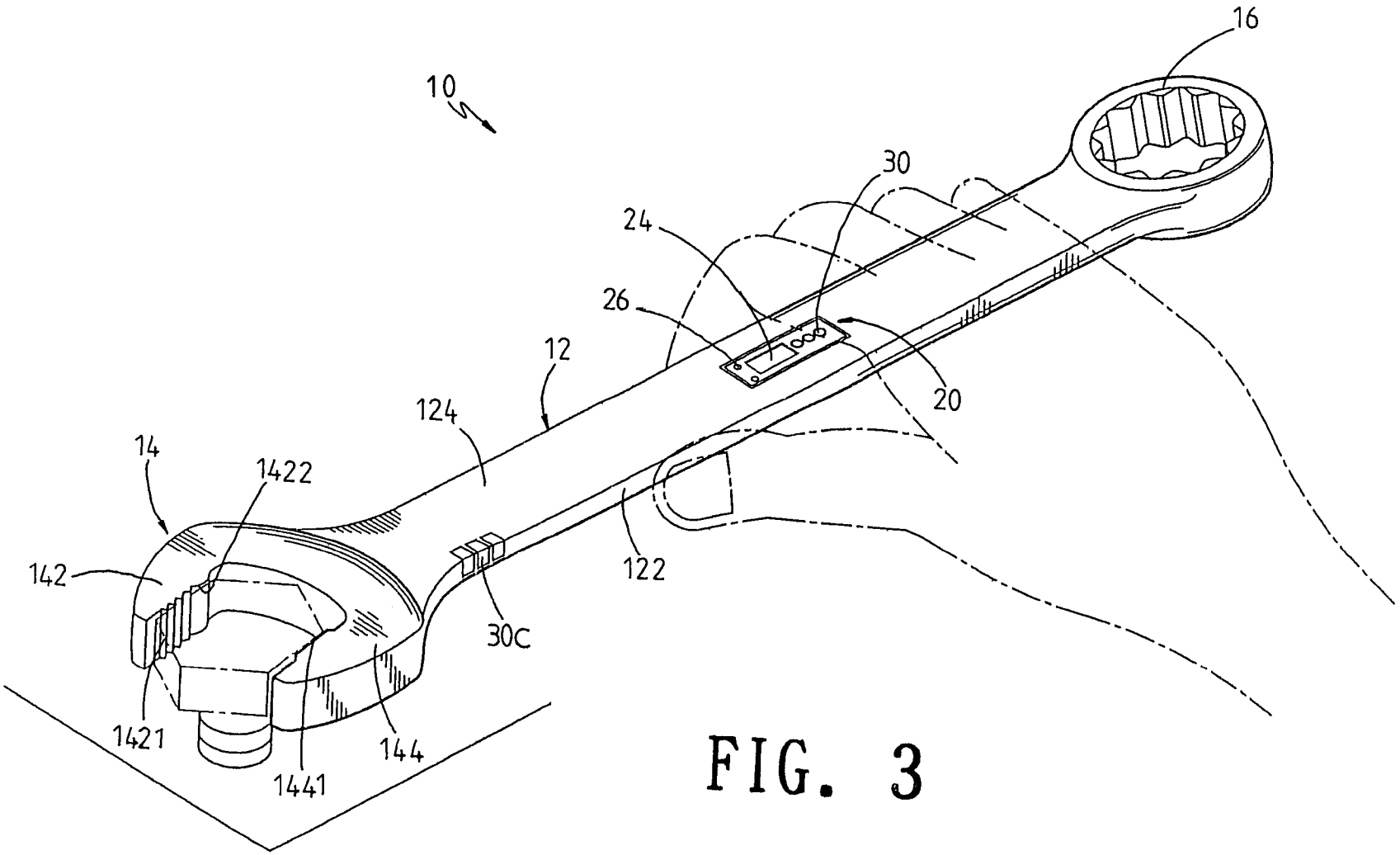
FIG. 3 shows the third embodiment of the hand tool alert device of the present invention.
Figure 4:
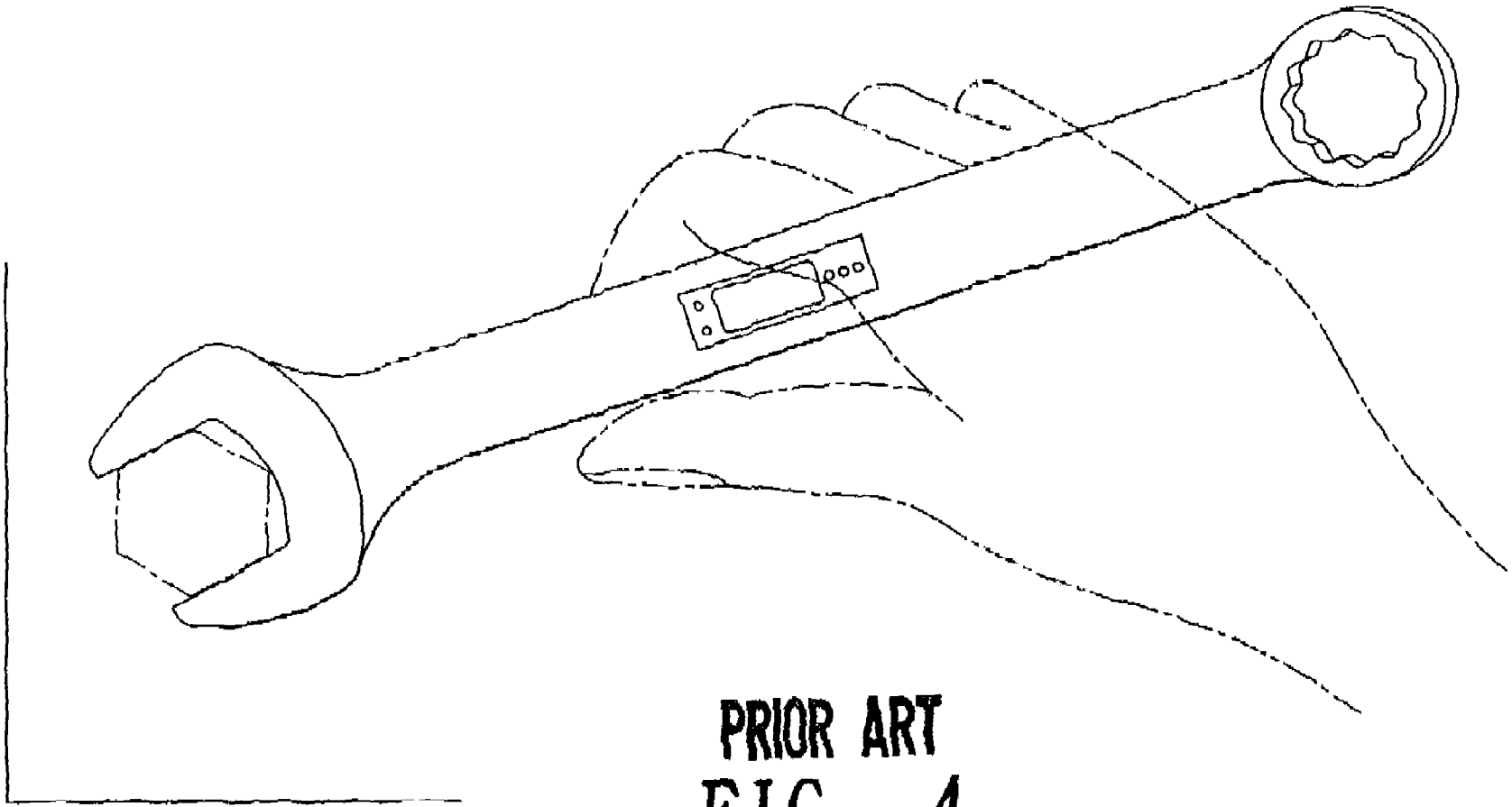
PRIOR ART FIG. 4
FIG. 4 is a schematic perspective view of the prior art hand tool alert device.

Referring to FIG. 3, the third embodiment of the present invention is illustrated. Those identical to the second embodiment will not be described. Only those differences are described. In this embodiment, the auxiliary alarm unit 30*c* is a set of colored light emitting bodies which are arranged across two sides 124, 122 of the handle 12. Thus, the user can view the alarm unit 30 or the auxiliary alarm unit 30*c* at the two sides. Thus the user can view the alarm easily and conveniently.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A hand tool with at least two alarm devices comprising:

a handle with having a rectangular shape which is formed by has two first parallel surfaces and two second parallel narrow surfaces connected between the two first surfaces; at least one end of the handle being formed with a driving head;

an output device being at a middle part of the handle and having a sensing unit; the sensing unit being electrically connected to a strain gauge installed at a predetermined position of the handle; and the output device having an alarm device; and a recess formed by only two inclined triangular surfaces being formed at an edge between two adjacent surfaces of the handle and being at an area near the driving head and an auxiliary alarm device installed on one of the inclined surfaces.

2. The hand tool with at least two alarm devices as claimed in claim 1, wherein a surface of the output device has a display for displaying the deformation of the hand tool; and the display is installed with functional setting buttons.

3. The hand tool with at least two alarm devices as claimed in claim 2, wherein the setting buttons serve for turning on and off of the output device and setting the balance of a resistance of a bridge circuit of a strain gauge.

4. The hand tool with at least two alarm devices as claimed in claim 1, wherein the alarm device and auxiliary alarm device are formed of light emitting bodies of different colors.

5. The hand tool with at least two alarm devices as claimed in claim 1, wherein one end of the handle is formed with an opened driving head and another end thereof is a ring driving head.

6. The hand tool with at least two alarm devices as claimed in claim 1, wherein the opened driving head has two jaws; one inner surface of one jaw has a teeth portion having four continuous teeth for enhancing the strength for clamping a screw object and a protruded cambered portion at an inner side near the handle for reducing the stress at apexes of an object to be driven; and an inner surface of another jaw is formed with a protrusion with a flat surface facing toward another jaw.

7. A hand tool with at least two alarm devices comprising:

a handle with having a rectangular shape which is formed by has two first parallel surfaces and two second parallel narrow surfaces connected between the two first surfaces; at least one end of the handle being formed with a driving head;

an output device having a sensing device; the sensing device being electrically connected to a strain gauge installed at a predetermined position of the handle; and the output device having an alarm device; and an auxiliary alarm device arranged across two adjacent sides.

8. The hand tool with at least two alarm devices as claimed in claim 7, wherein a surface of the output device has a display for displaying the deformation of the hand tool; and the display is installed with functional setting buttons.

9. The hand tool with at least two alarm devices as claimed in claim 8, wherein the setting buttons serve for turning on and off of the output device and setting the balance of a resistance of a bridge circuit of a strain gauge.

10. The hand tool with at least two alarm devices as claimed in claim 7, wherein the alarm device and auxiliary alarm device are formed of light emitting bodies of different colors.

11. The hand tool with at least two alarm devices as claimed in claim 7, wherein one end of the handle is formed with an opened driving head and another end thereof is a ring driving head.

12. The hand tool with at least two alarm devices as claimed in claim 7, wherein the opened driving head has two jaws; one inner surface of one jaw has a teeth portion having four continuous teeth for enhancing the strength for clamping a screw object and a protruded cambered portion at an inner side near the handle for reducing the stress at apexes of an object to be driven; and an inner surface of another jaw is formed with a protrusion with a flat surface facing toward another jaw.

* * * * *